US009469456B2

(12) United States Patent
Grell

(10) Patent No.: US 9,469,456 B2
(45) **Date of Patent: *Oct. 18, 2016**

(54) RIM TABBED DRIZZLE SAFETY SEAL AND METHODS OF USE

(71) Applicant: Mathew L. Grell, Peachtree Corners, GA (US)

(72) Inventor: Mathew L. Grell, Peachtree Corners, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/477,309

(22) Filed: Sep. 4, 2014

(65) Prior Publication Data

US 2016/0046422 A1 Feb. 18, 2016

Related U.S. Application Data

(63) Continuation-in-part of application No. 14/461,795, filed on Aug. 18, 2014.

(51) Int. Cl.

| | |
|---|---|
| ***B65D 17/00*** | (2006.01) |
| ***B65D 47/04*** | (2006.01) |
| ***B65D 51/18*** | (2006.01) |
| ***B65D 43/02*** | (2006.01) |
| ***B65D 43/16*** | (2006.01) |
| ***B65D 77/20*** | (2006.01) |
| ***B65D 51/20*** | (2006.01) |
| ***B65D 53/08*** | (2006.01) |

(52) U.S. Cl.

CPC ..... *B65D 77/2024* (2013.01); *B65D 51/20* (2013.01); *B65D 53/08* (2013.01); *B65D 17/163* (2013.01); *B65D 43/02* (2013.01); *B65D 43/022* (2013.01); *B65D 43/16* (2013.01); *B65D 47/04* (2013.01); *B65D 51/18* (2013.01); *B65D 51/185* (2013.01); *B65D 77/206* (2013.01); *B65D 2231/025* (2013.01); *B65D 2251/0015* (2013.01); *B65D 2251/0021* (2013.01); *B65D 2251/0028* (2013.01); *B65D 2251/0093* (2013.01); *B65D 2517/0013* (2013.01); *B65D 2517/0049* (2013.01); *B65D 2543/00231* (2013.01); *B65D 2543/00833* (2013.01)

(58) Field of Classification Search

CPC ..... B65D 43/022; B65D 2543/00231; B65D 2543/00833; B65D 77/206; B65D 51/20; B65D 51/185; B65D 47/06; B65D 2517/0085; B65D 2517/0086; B65D 2517/0088; B65D 17/161; B65D 17/163; B65D 17/165; B65D 17/166; B65D 17/16; B65D 77/2024; B65D 53/08; B65D 2231/025; B65D 2251/0015; B65D 2251/0093; B65D 51/18; B65D 47/00; B65D 41/04; B65D 43/0202; B65B 69/00; B32B 7/10; B32B 7/12

See application file for complete search history.

(56) References Cited

U.S. PATENT DOCUMENTS

| | | | | |
|---|---|---|---|---|
| 603,559 | A | 5/1898 | Elder | |
| 1,160,571 | A | 11/1915 | Buffington | |
| 4,189,060 | A * | 2/1980 | Trotman, III | B65D 17/505 220/260 |
| 4,445,620 | A * | 5/1984 | Brochman | B65D 17/505 220/260 |
| 4,564,121 | A * | 1/1986 | Brochman | B65D 17/505 220/359.3 |

(Continued)

*Primary Examiner* — Frederick C Nicolas

(74) *Attorney, Agent, or Firm* — Mathew L. Grell

(57) ABSTRACT

A container having an opening, a first seal covering the container opening, the first seal having an aperture or passageway positioned therein and proximate a periphery edge, a second seal hingedly affixed thereto said first seal proximate said periphery to close off the aperture, and, thus, when such second seal is removed functions to provide reduced or restricted pouring capacity of the container contents via said aperture in the first seal.

20 Claims, 9 Drawing Sheets

(56) References Cited

U.S. PATENT DOCUMENTS 4,595,114 A * 6/1986 Lu ..... B65D 17/502 220/260
4,715,528 A * 12/1987 Kjelgaard ..... B65D 5/708 220/359.2
4,735,335 A * 4/1988 Torterotot ..... B32B 15/08 220/260
4,754,890 A 7/1988 Ullman et al.
4,762,246 A * 8/1988 Ashley ..... B65D 77/206 220/270
4,822,326 A 4/1989 Ullman et al.
5,004,111 A * 4/1991 McCarthy ..... B65D 51/20 215/232
5,108,356 A 4/1992 Rickenbach 215/232
5,125,529 A * 6/1992 Torterotot ..... B65D 77/206
5,513,781 A * 5/1996 Ullrich ..... B65D 47/185 215/232
5,514,442 A * 5/1996 Galda ..... B65D 51/20 215/232
8,715,825 B2 * 5/2014 Thorstensen-Woll B65D 77/2032 428/343
8,746,484 B2 * 6/2014 Thorstensen-Woll .... B32B 7/06 215/232
2005/0218143 A1 * 10/2005 Niederer ..... B65D 77/206 220/359.2
2006/0289542 A1 * 12/2006 Schedl ..... B29C 65/02 220/359.2
2013/0020324 A1 * 1/2013 Thorstensen-Woll .... B32B 7/06 220/270

* cited by examiner

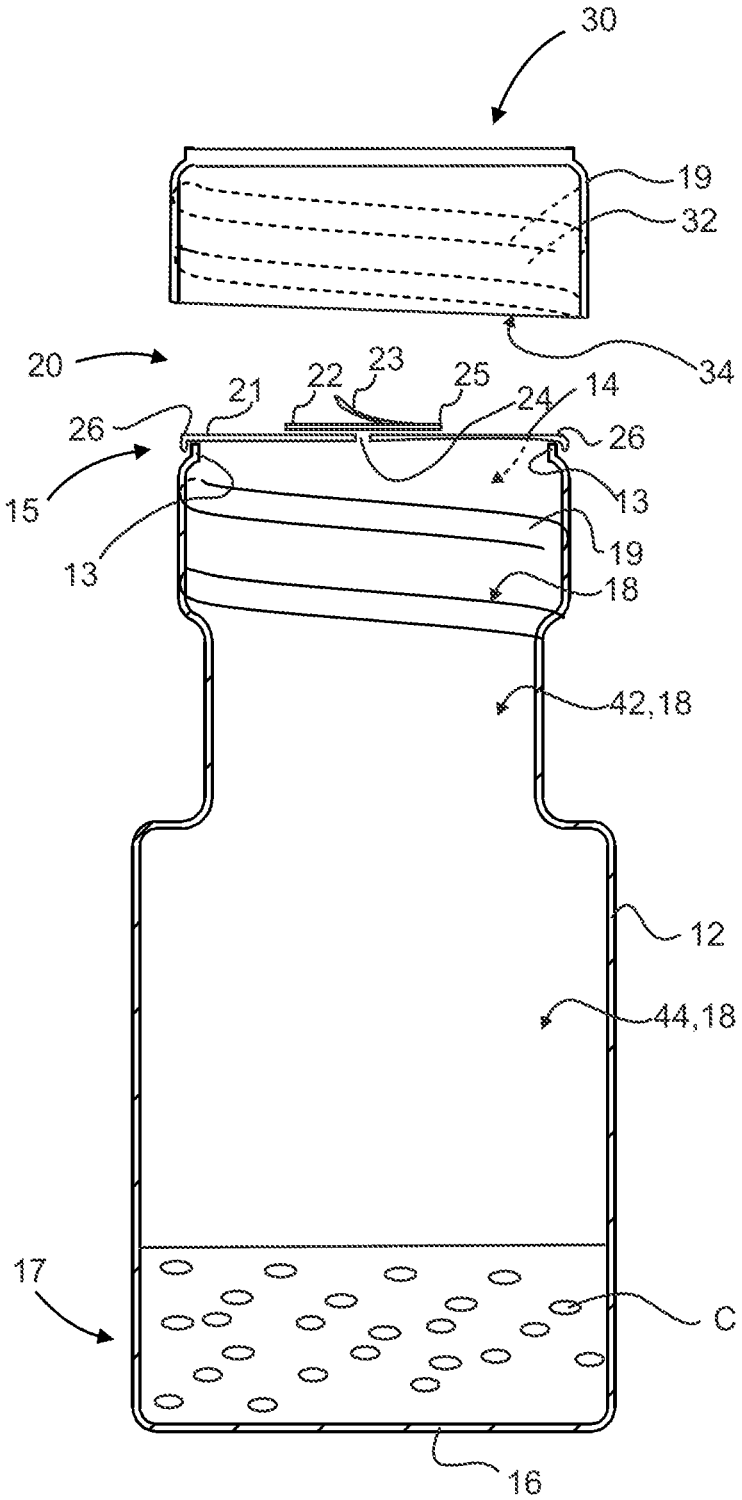
Fig. 1
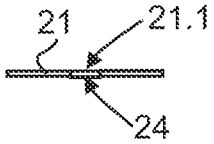
Fig. 1.1

RIM TABBED DRIZZLE SAFETY SEAL AND METHODS OF USE

CROSS REFERENCE TO RELATED APPLICATIONS

To the full extent permitted by law, the present United States Non-Provisional patent application claims priority to and the full benefit of United States Non-Provisional patent application entitled "Drizzle Safety Seal and Methods of Use", filed on Aug. 18, 2014, having assigned Ser. No. 14/461,795, incorporated entirely herein by reference.

TECHNICAL FIELD

The disclosure relates generally to liquid containers or receptacle and more specifically it relates to safety seals or tamper resistant seals.

BACKGROUND

Various containers such as plastic, metal, and glass bottles are known in the prior art, for example, there are plastic and glass bottles which contain a variety of consumable products available on the market. It is known to configure such containers with a safety seal, tamper resistant seal or other bottle cap safety sealing device over the opening to prevent tampering with the contents of the container prior to purchase.

One previous approach is to provide a plastic or foil seal to cover the bottle opening to prevent tampering with the contents of the container prior to purchase. Such seal may be removed upon purchase to verify that the contents of the container have not been tampered with prior to purchase. One disadvantage of this approach is that upon removing the seal the entire bottle opening is exposed and a user must be careful not to over pour the fluid contents out of the bottle.

Another previous approach is to provide a bottle cap with a tamper proof device to prevent tampering with the contents of the container prior to purchase. Such tamper proof device may be removed upon purchase to verify that the contents of the container have not been tampered with prior to purchase. One disadvantage of this approach is that of added cost to the design and manufacture of the bottle cap plus such tamper proof device are hard to open, especially for the elderly and handicapped.

Another previous approach is to provide a bottle stopper or stopper with a pourer or flow device to be wedged into the bottle opening inner wall to stop flow or restrict flow. Such stopper or stopper with a pourer is sold separately. One disadvantage of this approach is that of the added cost to purchase these separate items and the open exposure to the air may deteriorate the content in the bottle.

Therefore, it is readily apparent that there is a recognizable unmet need for a drizzle safety seal and methods of use, wherein a resealable secondary seal covers a hole in the primary seal and when removed enables drizzle pouring of the container contents via said hole.

BRIEF SUMMARY

Briefly described, in example embodiment, the present apparatus overcomes the above-mentioned disadvantage, and meets the recognized need for a drizzle safety seal and methods of use comprising, in general, a container having an opening, a first seal covering the container opening, the first seal having an aperture or passageway positioned therein, a second seal to close off the aperture, and, thus, when such second seal is removed functions to provide reduced or restricted pouring capacity of the container contents via said aperture in the first seal.

According to its major aspects and broadly stated, the a bottle with drizzle safety seal and methods of use comprising, in general, a container having an opening, a first seal covering the container opening, the first seal having an aperture positioned therein, a second seal formed as a foldable pull tab or flap to cover the aperture, and, thus, when such second seal is removed functions to provide reduced or restricted pouring capacity of the container contents via said aperture in the first seal.

Moreover, a container having an opening, a first seal covering the container opening, the first seal having an aperture or passageway positioned therein, a second seal hingedly affixed thereto said first seal proximate said periphery to close off the aperture, and, thus, when such second seal is removed functions to provide reduced or restricted pouring capacity of the container contents via said aperture in the first seal.

In an exemplary embodiment an apparatus, including a two-part seal, the two part seal having a first seal and a second seal, the first seal having an aperture formed therethrough the first seal, and the second seal releasably affixed thereto the first seal to close off the aperture.

In a further exemplary embodiment a container seal system, the seal system including a container having an opening formed by a rim, the container filled with a content, and a two-part seal, the two part seal having a first having a periphery releasably affixed thereto the rim and a second seal, the first seal having a aperture formed therethrough the first seal, and the second seal releasably affixed thereto the first seal to close off the aperture.

In a further exemplary embodiment of the method of method of reducing a flow of a content from a container, including steps of providing a container and a cap removeably affixed thereto, the container having an opening formed by a rim, the container filled with the content, and a two-part seal, the two part seal having a first having a periphery releasably affixed thereto the rim and a second seal, the first seal having a aperture formed therethrough the first seal, and the second seal releasably affixed thereto the first seal to close off the aperture, removing the cap therefrom the container, removing the second seal from the first seal, exposing the aperture, inverting the container to pour the content therethrough the aperture, and restricting flow of the content through the aperture.

Accordingly, a feature of the drizzle safety seal and methods of use is its ability to provide a two part safety seal for a container having a first seal to cover the container opening and functions primarily to enable verification that the contents of the container have not been tampered with prior to purchase and in addition the first seal provides a barrier to position a restricted or reduced flow aperture therein.

Another feature of the drizzle safety seal and methods of use is its ability to provide a second seal covering the restricted or reduced flow aperture to enable removal thereof of second seal to provide restricted or reduced flow of container content through the restricted or reduced flow aperture.

Still another feature of the drizzle safety seal and methods of use is its ability to enable removal thereof first seal to provide unrestricted fluid flow out of container opening.

Yet another feature of drizzle safety seal and methods of use is its ability to provide a choice of two flow options, such as unrestricted container content flow through container opening and restricted or reduced container content flow through restricted or reduced flow aperture.

Yet another feature the drizzle safety seal and methods of use is its ability to provide pull tabs affixed to either the first seal and/or the second seal to enable ease of gripping and pulling on the first seal and/or the second seal to aid in their removal.

Yet another feature the drizzle safety seal and methods of use is its ability to provide resealable seal for second seal to enable multi-use open and closure of restricted or reduced flow aperture.

Yet another feature of the drizzle safety seal and methods of use is its ability to be processed by existing beverage container processing equipment, such as filler, sealer, or capping machines, collectively a standard container process.

Yet another feature of the drizzle safety seal and methods of use is its ability to provide improved elements and arrangements thereof in a container for the purposes described herein which are inexpensive, dependable and fully effective in accomplishing its intended purposes.

Yet another feature of the drizzle safety seal and methods of use is its ability to provide a seal to ensure that no foreign material has entered the container after it has been filled with the intended product or content.

Yet another feature of the drizzle safety seal and methods of use is its ability to provide a seal to prevent purposeful tampering, because access to the interior of the container cannot be achieved without destroying the seal.

Yet another feature of the drizzle safety seal and methods of use is its ability to provide a seal having an integral tab making its removal simple and effective.

Yet another feature of the drizzle safety seal and methods of use is its ability to provide a tamper evident container sealing system which is capable of use in an open position and resealed in a closed position.

Yet another feature of the drizzle safety seal and methods of use is its ability to provide spill-free pouring of liquids through a designated hole, rather than above a "dam" of aluminum in some kind of torn seal configuration.

Yet another feature of the drizzle safety seal and methods of use is its ability to provide a tamper evident bottle sealing system which is capable of use in a variety of different situations.

These and other features of the drizzle safety seal and methods of use will become more apparent to one skilled in the art from the following Detailed Description of the Embodiments and Claims when read in light of the accompanying drawing Figures.

BRIEF DESCRIPTION OF THE DRAWINGS

The present drizzle safety seal and methods of use will be better understood by reading the Detailed Description of the embodiments with reference to the accompanying drawing figures, in which like reference numerals denote similar structure and refer to like elements throughout, and in which:

FIG. 1 is a front cross sectional view of a typical container having a screw cap removed with the container mouth sealed with an example embodiment of the drizzle safety seal;

FIG. 1.1 is a front cross sectional view of another example embodiment of the drizzle safety seal of FIG. 1 with second seal configured as a plug positioned therein aperture;

FIG. 9.1 is a front top perspective view of an example embodiment of the rim tabbed drizzle safety seal of FIG. 9.

Figure 2:
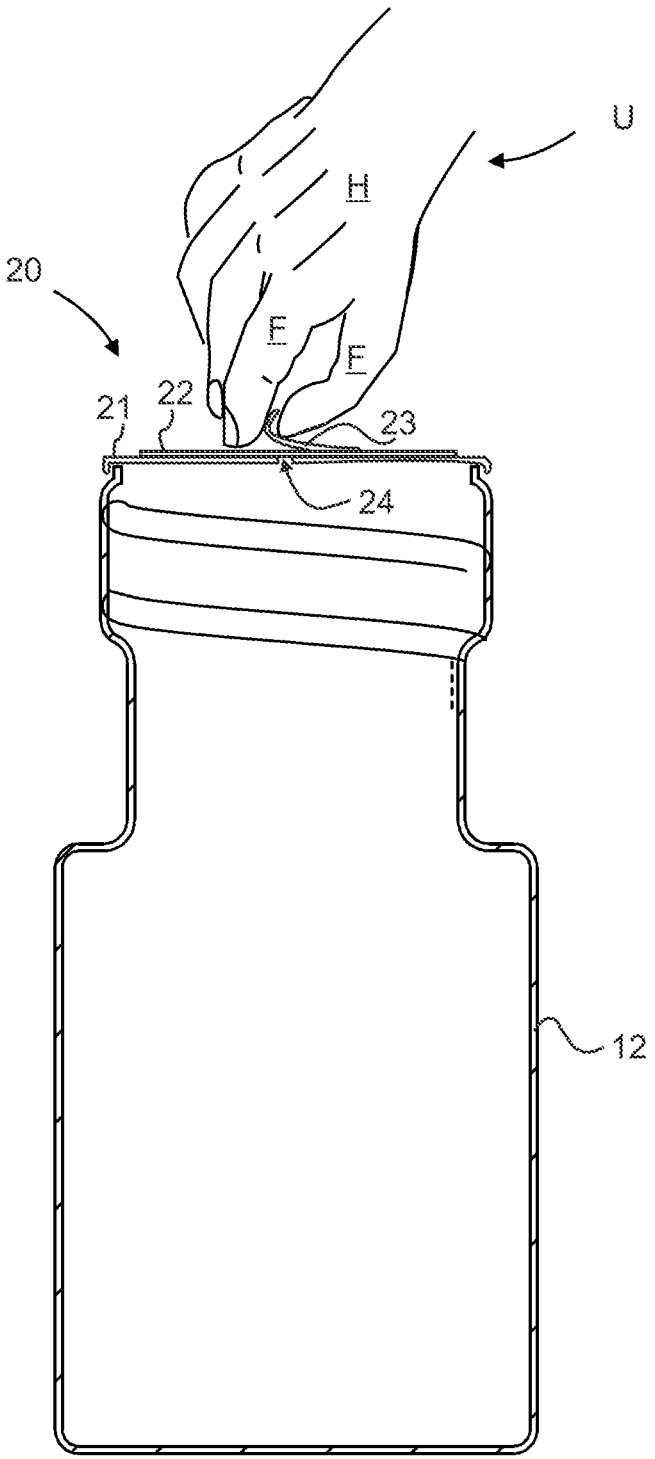
FIG. 2 is a front cross sectional view of an example embodiment of the drizzle safety seal of FIG. 1 with the second seal being gripped by a user's fingers.

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION

In describing the exemplary embodiments of the present disclosure, as illustrated in FIGS. 1-9.1 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIG. 1, by way of example, and not limitation, there is illustrated a typical container having a screw cap, the container having its mouth sealed with a tamper evident safety multi-part, two-part, or two stage seal 20. Preferably container 12 having a container opening, such as mouth 14 positioned at one end, upper end, or first end 15 of container 12 and a container footing, such as base 16 positioned at another end, lower end, or second end 17 of container 12. Mouth 14 preferably having a lip, such as rim 13. Moreover, container 12 having exterior surface 18. Preferably exterior surface 18 may include one or more threads 19 configured in a spiral configuration and positioned thereon exterior surface 18 proximate first end 15 of container 12.

It is contemplated herein that container 12 may include a body portion 44 and neck 42 and may be of any shape or configuration. It is further contemplated herein that container 12 may contain or be filled with content C, such as consumable or non-consumable product(s), fluid(s), powder (s), oil(s), pharmaceutical(s), food product(s), any flowable liquid substance or collection of separable solids, granular solid(s), fungible goods and the like.

Container 12 may include a lid or screw cap, such as cap 30 having downwardly depending interior surface 32 and cap opening 34 configured to fit over exterior surface 18 proximate first end 15 of container 12. Interior surface 32 may include one or more threads 19 configured internally in a spiral configuration and positioned thereon interior surface 32. Other attachment mechanisms other than offset threads, such as one or more threads 19 may be contemplated herein to releasably affix cap 30 thereto container 12, such as snap lock, friction fit, shrink wrap and the like.

Container 12 and/or cap 30 may be formed of a suitable material, such as rigid plastic or flexible plastic, polyethylene, polypropylene, glass, glass with polymer coated neck or rim, aluminum, steel, metal, tin, alloy, stainless steel, or the like, capable of providing structure to container 12. Preferably, the material includes other suitable characteristics, such as durability, rust-resistance, light weight, ability to hold contents under pressure, heat-resistance, chemical inertness, oxidation resistance, ease of workability, or other beneficial characteristic understood by one skilled in the art.

Container 12 preferably includes a tamper evident or tamper resistant safety seal, block or blocking content C, sealing liner, film, or layer or combinations thereof, such as first seal 21 having an edge, such as first periphery 26 and a diameter such as to circumferentially cover, close, close off, cover, or seal mouth 14 of container 12. It is contemplated herein that first periphery 26 of first seal is preferably configured to be a little bit larger or greater diameter than rim 13 of mouth 14, and thus, first seal 21 may extend to rim 13 of mouth 14 or beyond and facilitate releasable adherence thereto rim 13 of mouth 14, such as by heat welding, induction heating, adhesive, or the like to hold or maintain content C therein container 12 and prevent tampering thereof.

Preferably first seal 21 includes a restricted or reduced flow (rate and resulting volume) aperture, passageway or hole, such as aperture 24 therethrough first seal 21 as a retrieval port of the content C contained within the barrier of first seal 21 and therein container 12. It is contemplated herein that aperture 24 provides reduced or restricted pouring or retrieval or flow capacity of content C via aperture 24 positioned in first seal 21. It is contemplated herein that aperture 24 may include one or more apertures therein first seal 21 and that such aperture 24 may be configured in any of a variety of shapes. It is further contemplated herein that aperture 24 preferably is a smaller or reduced size or area opening or area than mouth 14 resulting in a lower or reduced flow (restricted flow or first flow) of content C exiting container 12 for aperture 24 verses opened mouth 14 of container 12 (second flow). It is contemplated herein that aperture 24 may include two or more apertures and that one of said additional apertures may be used as an air vent.

Preferably positioned over, therein, or covering aperture 24 therein first seal 21 may be a tamper evident or tamper resistant safety seal, film, plug, or layer or combinations thereof, such as second seal 22 having an edge, such as second periphery 25 and a width such as to close, close off, cover, or seal aperture 24 to maintain content C therein container 12. It is contemplated herein that second periphery 25 of second seal 22 is preferably configured to be larger or greater diameter or width than aperture 24 and to facilitate releasable adherence therebetween first seal 21 and second seal 22, such as by static attraction, adhesive or the like to hold or maintain content C therein container 12.

It is contemplated herein that second seal 22 may be configured as plug 22.1 positioned therein aperture 24 and formed removeably integral thereto first seal 21 and may be perforated so as to be punched or popped out of first seal 21 to form aperture 24, as shown in FIG. 1.1.

First seal 21 and/or second seal 22 may be formed of a suitable material, such as aluminum foil, aluminum foil or other metallic layer, may be coated with polymer, polymer coated, may be laminated to paper layer, may have a reinforcing layer, such as a scrim layer, or may be foam, thin film plastic, or polymer, or other thin removeable material or combination layer, capable of providing a seal or barrier for mouth 14 and/or aperture 24 of container 12. Preferably, the material includes other suitable characteristics, such as durability, light weight, laminate, ability to hold content C therein container 12, ability to facilitate adherence of first seal 21 to rim 13 of mouth 14 and/or second seal 22 to first seal 21, heat-resistance, chemical inertness, oxidation resistance, ease of workability, or other beneficial characteristic understood by one skilled in the art.

Referring now to FIG. 2, by way of example, and not limitation, there is illustrated container 12 with the container mouth sealed with an example embodiment example embodiment multi-part seal 20, shown with second seal 22 being gripped by a user's fingers F. Moreover, first seal and/or second seal 22 may include an attached projection, flap, short strip, or pull tab, such as tab 23 (shown on second seal 22) to help facilitate removal of first seal 21 and/or second seal 22 through grasping and pulling second seal 22 by the user U. Preferably tab 23 is sufficiently large or long enough so that it can be grasped by the fingers F of user's hand H and will usually have sufficient strength so as to permit removal or partial removal of first seal 21 from rim 13 of mouth 14 and/or second seal 22 from first seal 21.

Figure 4:
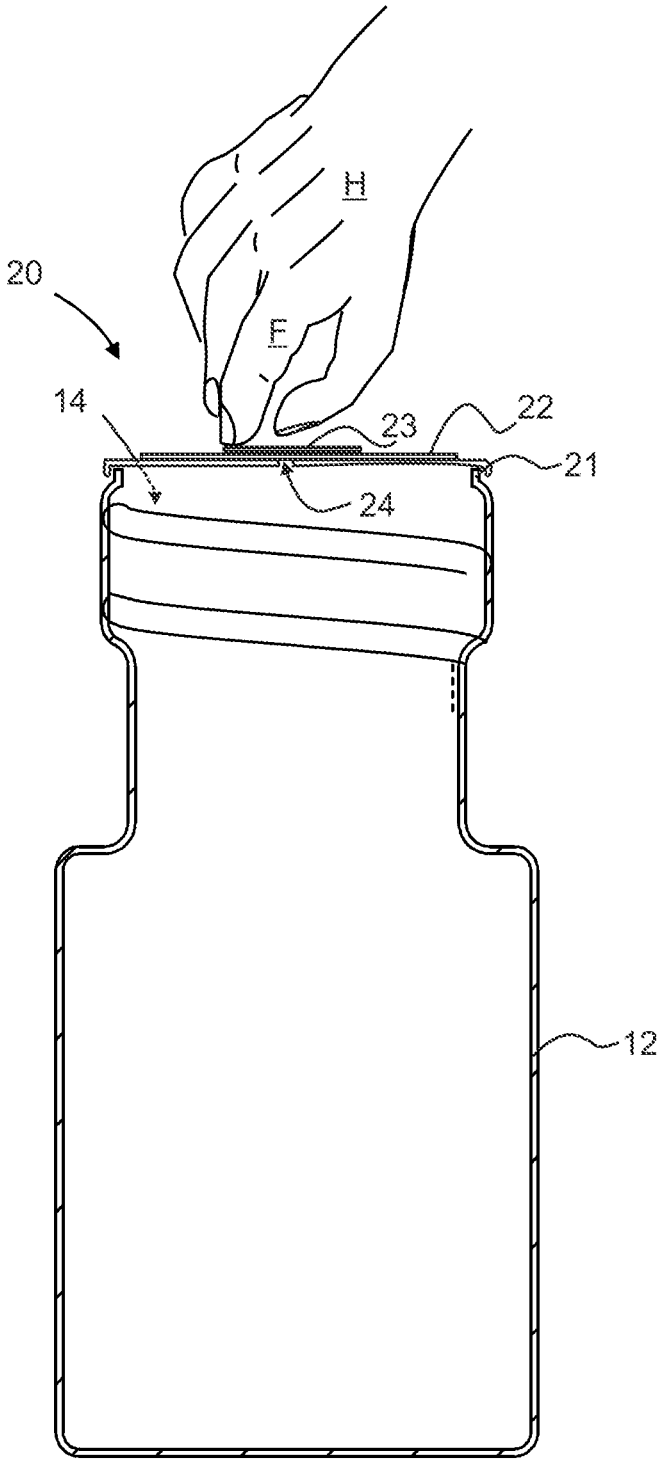
FIG. 4 is a front side perspective view of an example embodiment of the drizzle safety seal of FIG. 1 shown with upright container having second seal reclosed sealing or closing restricted or reduced flow aperture maintaining content therein the container.
Figure 5:
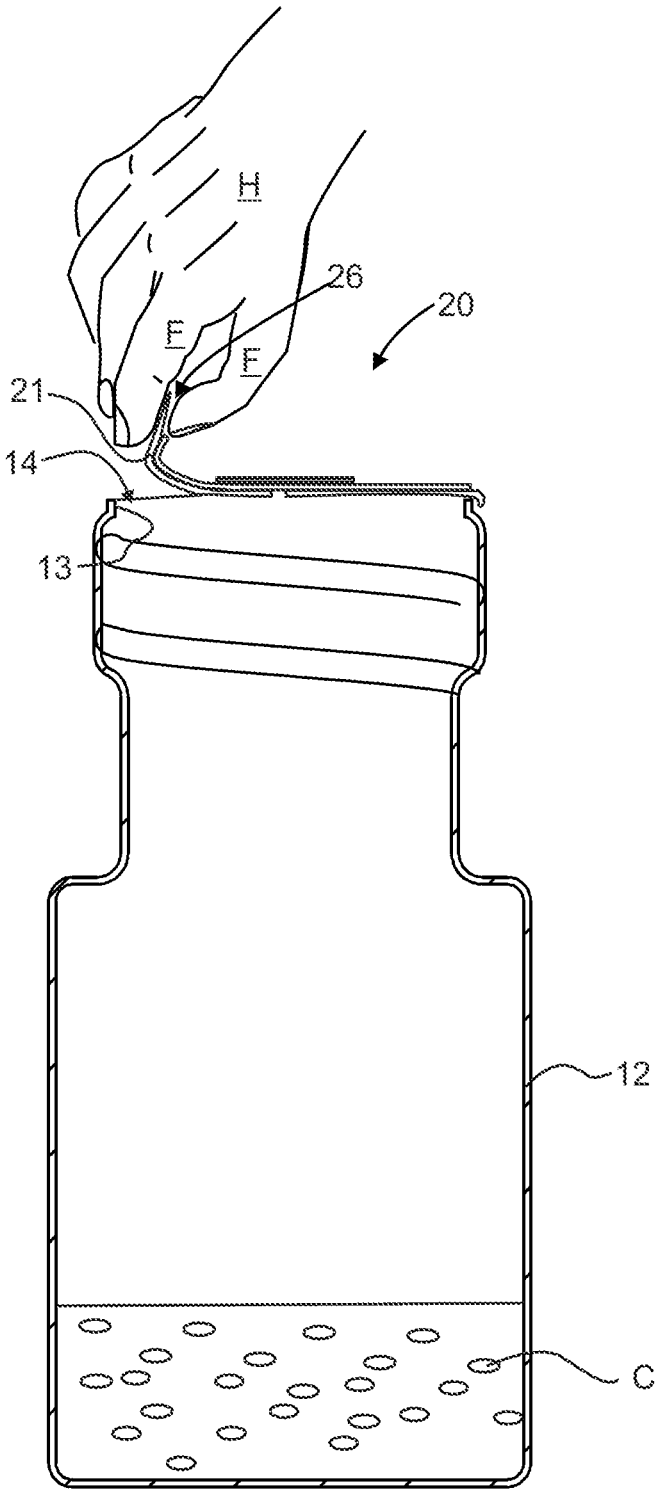
FIG. 5 is a front cross sectional view of an example embodiment of the drizzle safety seal of FIG. 1 with the first seal being gripped and removed by a user's fingers.

It is contemplated herein that removal of first seal and/or second seal 22 may be accomplished by grasping and pulling on first periphery 26 of first seal 21 as shown in FIG. 5 or second periphery 25 of second seal 22 as shown in FIG. 4, respectively, by the fingers F of a user's hand H.

Figure 3:
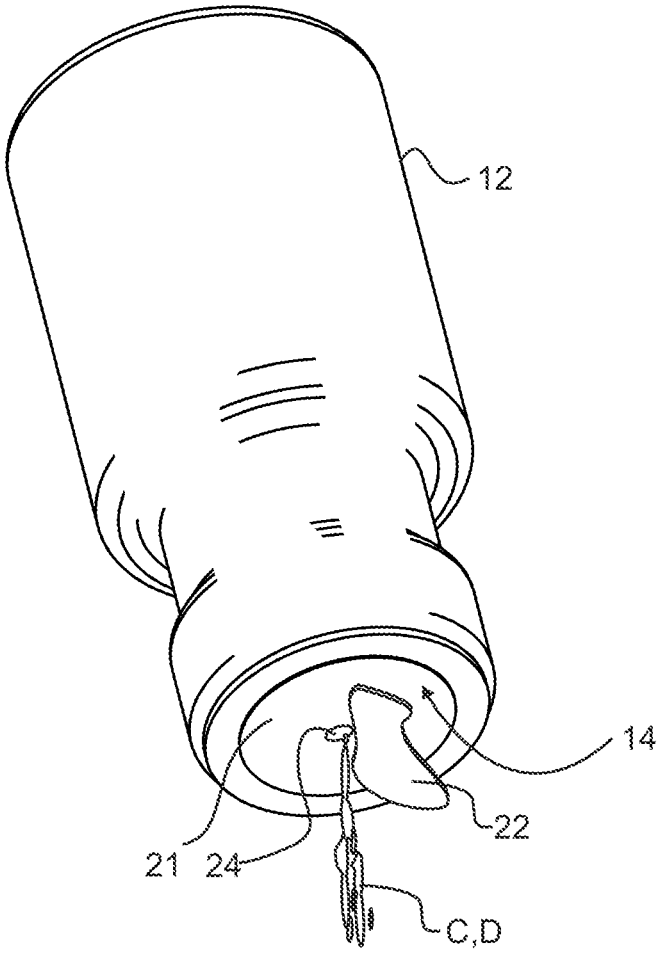
FIG. 3 is a front side perspective view of an inverted container with an example embodiment of the drizzle safety seal of FIG. 1 shown with second seal partially removed enabling restricted or reduced flow of container content via the aperture.

Referring now to FIG. 3, by way of example, and not limitation, there is illustrated container 12 inverted with second seal 22 removed or partially removed exposing aperture 24. Preferably second seal 22 may be removed or partially removed from first seal 21, as shown in FIG. 2, partially exposing or opening first seal 21 of container 12, via aperture 24. Preferably open aperture 24 therein first seal 21 together with inverted container 12 enables restricted flow (first flow) of content C through aperture from container 12, such as a drizzle D of content C exiting container 12 in comparison to if first seal 21 were removed from mouth 14 of container 12 enables an open mouth flow (second flow). It is contemplated herein that aperture 24 preferably is a smaller or reduced opening or area than mouth 14 resulting in a lower or reduced flow (first flow) of content C exiting container 12 via aperture 24 verses open mouth 14 of container 12 (second flow).

It is contemplated herein that second seal 22 may be removed from first seal 21 exposing or opening first seal 21 of container 12, via aperture 24 and that cap 30 fitted thereto or releasably affix thereto container 12 may be utilized to temporarily seal aperture 24. Cap 30 may be removed and together with inverted container 12 enables restricted flow of content C through aperture 24 from container 12, such as a drizzle D content C exiting container 12. Drizzle D represents first flow (rate and resulting volume) of content C through aperture 24 to be less than a possible second flow of content through opened mouth 14. It is further contemplated herein that cap 30 may be attached, fit over exterior surface 18 proximate first end 15 of container 12 to cover, close, close off, block, shut off, or seal aperture 24 and to maintain content C therein container 12.

Referring now to FIG. 4, by way of example, and not limitation, there is illustrated a container 12 with the container mouth 14 sealed with an example embodiment multi-part seal 20, shown with second seal 22 or tab 23 being gripped by a user's fingers F. Preferably removal or partial removal of second seal 22 may be accomplished by grasping and pulling second periphery 25 or tab 23 of second seal 22, respectively, by the fingers F of a user's hand H to expose or open aperture 24. Moreover, second seal may be reclosed by reseating, resealing, or pressing second seal 22 (or second periphery 25 or tab 23 of second seal 22) toward or back against first seal 21, and thus resealing or providing a barrier to hold content C within container 12.

Referring now to FIG. 5, by way of example, and not limitation, there is illustrated container 12 with an example embodiment multi-part seal 20 showing the container mouth 14 partially un-sealed. Preferably first seal 21 may be removed or partially removed from rim 13 of mouth 14 of container 12 and this may be accomplished by the fingers F of a user's hand H grasping and pulling of first periphery 26 of first seal 21 therefrom rim 13 exposing or opening mouth 14 of container 12. It is contemplated herein that mouth 14 is preferably a larger opening or area than aperture 24 resulting in a higher or increased flow of content C exiting container 12 via mouth 14 verses aperture 24 when container 12 is inverted.

It is contemplated herein that first seal 21 be of a size so as to form generally sealing liners of the necessary diameter to fit mouth 14 of the intended container 12.

Figure 6:
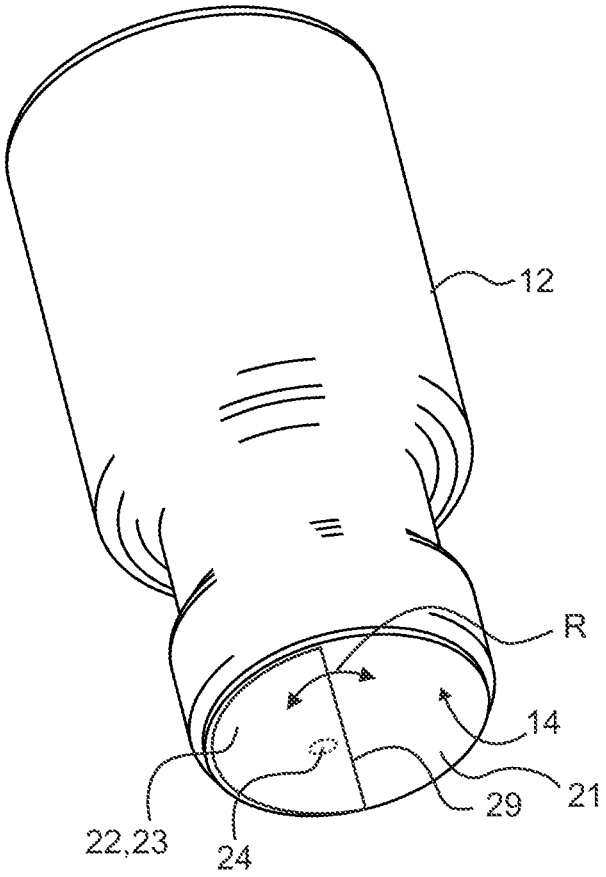
FIG. 6 is a front side perspective view of an example embodiment of the drizzle safety seal of FIG. 1 shown with inverted container having second seal formed from a tab or flap integral to the first seal and shown folded or rotated over to cover restricted or reduced flow aperture and to seal content therein the container.

Referring now to FIG. 6, by way of example, and not limitation, there is illustrated container 12 inverted with an example embodiment multi-part seal 20. In this embodiment first seal 21 circumferentially covers, closes, closes off, or seals mouth 14 of container 12, and includes a hole, such as aperture 24 off set from the center (center line 29) of first seal 21. Moreover, first seal 21 may include a flap or pull tab such as tab 23 (second seal 22) hingedly affixed thereto first seal 21 along pivot edge or center line, such as hinged edge 29. Preferably tab 23 (second seal 22) may be folded or rotated R over or to cover, close, close off, block, shut off, or seal aperture and to facilitate releasable adherence therebetween first seal 21 and tab 23 (second seal 22), such as by static attraction, adhesive or the like to maintain content C therein container 12.

Figure 7:
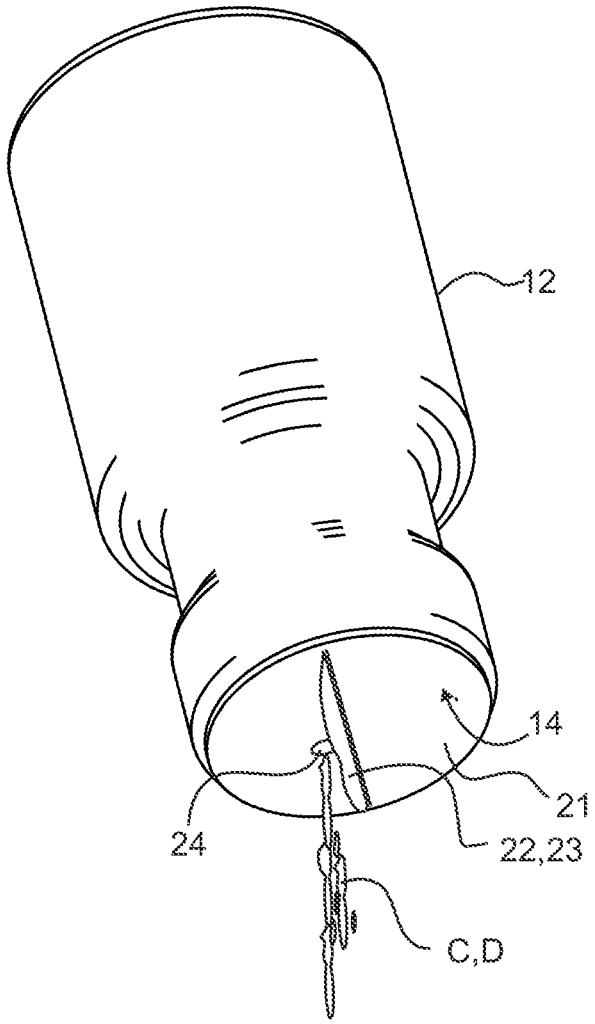
FIG. 7 is a front side perspective view of an example embodiment of the drizzle safety seal of FIG. 6 shown with inverted container having second seal opened exposing restricted or reduced flow aperture and enabling restricted or reduced flow of container content.

Referring now to FIG. 7, by way of example, and not limitation, there is illustrated container 12 of FIG. 6 inverted with an example embodiment multi-part seal 20. In this embodiment tab 23 (second seal 22) may be folded or rotated R along hinged edge 29 up away from aperture 24 to open or un-seal aperture 24 partially exposing or opening first seal 21 of container 12, via aperture 24. Preferably open aperture 24 therein first seal 21 together with inverted container 12 enables restricted flow of content C through aperture 24 from container 12, such as a drizzle D of content C exiting container 12 in comparison to if first seal 21 were removed from mouth 14 of container 12. It is contemplated herein that aperture 24 is a smaller or reduced opening or area than mouth 14 resulting in a lower or reduced flow of content C exiting container 12 via aperture 24 verses open mouth 14 of container 12. Preferably tab 23 is sufficiently large or long enough so that it can be grasped by the fingers F of a user's hand H and will usually have sufficient strength so as to permit removal or partial removal of first seal 21 from rim 13 of mouth 14 and/or second seal 22 from first seal 21.

Figure 8:
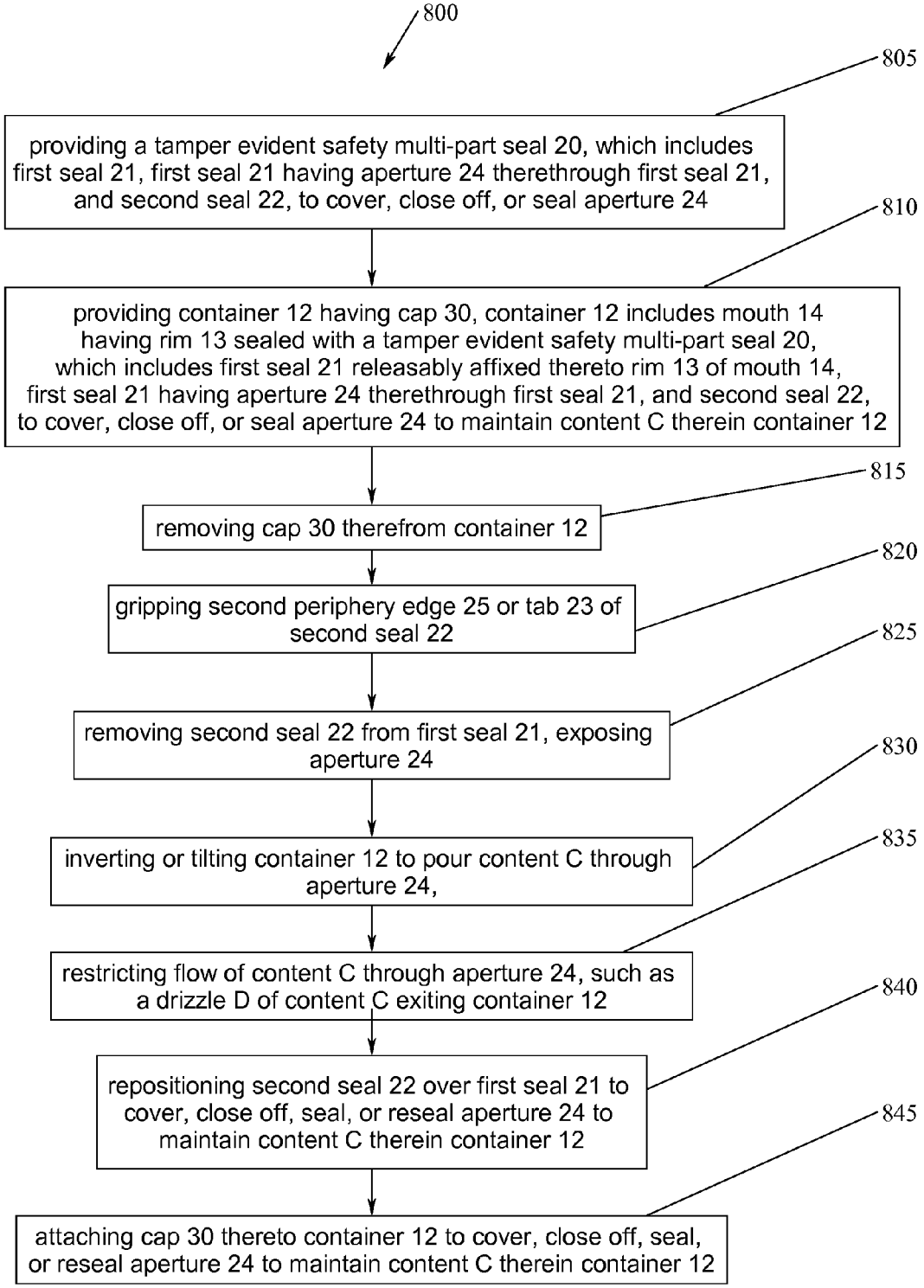
FIG. 8 is a flow diagram of a method of restricting the flow of content in a container through a restricted or reduced flow aperture.

Referring now to FIG. 8, by way of example, and not limitation, there is illustrated a flow diagram 800 of a method of reducing the flow of content C from container 12. In block or step 805, providing a tamper evident safety multi-part seal 20, which includes first seal 21, first seal 21 having aperture 24 therethrough first seal 21, and second seal 22, to cover, close, close off, block, shut off, or seal aperture 24, as described above in FIGS. 1-7. In block or step 810, providing container 12 having cap 30, container 12 includes mouth 14 having rim 13 sealed with a tamper evident safety multi-part seal 20, which includes first seal 21 releasably affixed thereto rim 13 of mouth 14, first seal 21 having aperture 24 therethrough first seal 21, and second seal 22, to cover, close, close off, block, shut off, or seal aperture 24 to maintain content C therein container 12, as described above in FIGS. 1-7. In block or step 815 removing cap 30 therefrom container 12. In block or step 820 gripping second periphery 25 or tab 23 of second seal 22. In block or step 825, removing second seal 22 from first seal 21, exposing aperture 24. In block or step 830, inverting or tilting container 12 to pour content C through aperture 24. In block or step 835, restricting flow of content C through aperture 24, such as a drizzle D of content C exiting container 12. In block or step 840, repositioning second seal 22 over first seal 21 to cover, close, close off, block, shut off, or reseal aperture 24 to maintain content C therein container 12. In block or step 845, attaching cap 30 thereto container 12 to cover, close, close off, block, shut off, or reseal aperture 24 to maintain content C therein container 12.

Figure 9:
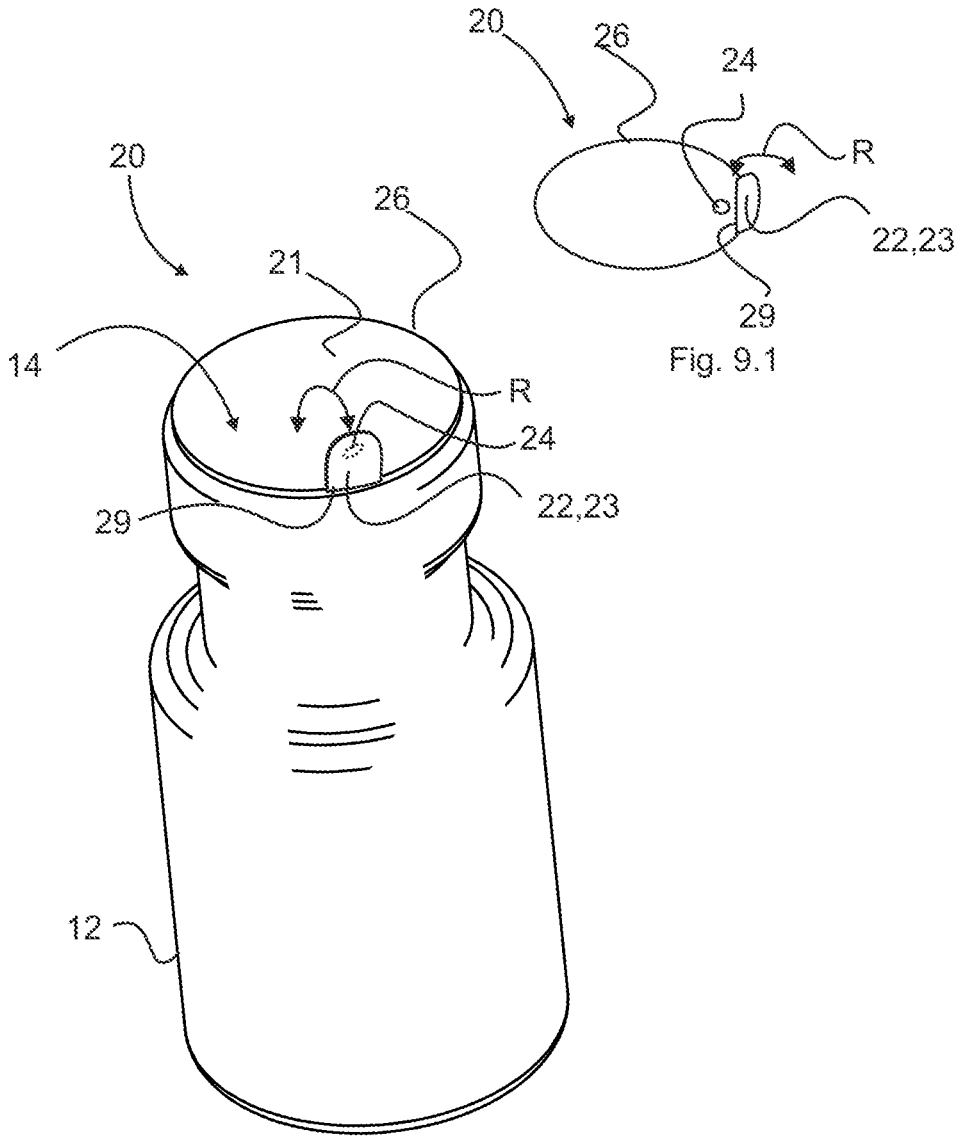
FIG. 9 is a front top perspective view of a typical container with the container mouth sealed with an example embodiment of a rim tabbed drizzle safety seal.

Referring now to FIG. 9, by way of example, and not limitation, there is illustrated container 12 with an example embodiment multi-part seal 20. In this embodiment first seal 21 circumferentially covers, closes, closes off, or seals mouth 14 of container 12, and includes a hole, such as aperture 24 proximate first periphery 26 of first seal 21. Moreover, first seal 21 may include a flap or pull tab, such as tab 23 (second seal 22) hingedly affixed thereto first seal 21 proximate first periphery 26 of first seal 21, such as hinged edge 29. Preferably tab 23 (second seal 22) may be folded or rotated R over or to cover, close, close off, block, shut off, or seal aperture 24 and to facilitate releasable adherence therebetween first seal and tab 23 (second seal 22), such as by static attraction, adhesive or the like to maintain content C therein container 12. Moreover, tab 23 (second seal 22) may be hinged about hinged edge 29 so as to move from first position laying flat against first seal 21, as shown in FIG. 9, configured to seal aperture 24 and may be hinged so as to move from first position to second position peeled or lifted off or above first seal 21, as shown in FIG. 9.1, configured as an open aperture 24 for such as a drizzle D of content C exiting container 12.

Referring now to FIG. 9.1, by way of example, and not limitation, there is illustrated an example embodiment multi-part seal 20. In this embodiment tab 23 (second seal 22) may be folded or rotated R along hinged edge 29 up away from aperture 24 to open or un-seal aperture 24 partially exposing or opening first seal 21. Preferably open aperture 24 therein first seal 21 together with inverted container 12 (as shown in FIG. 6) enables restricted flow of content C through aperture 24 from container 12, such as a drizzle D of content C exiting container 12 in comparison to if first seal 21 were removed from mouth 14 of container 12. It is contemplated herein that aperture 24 is a smaller or reduced opening or area than mouth 14 resulting in a lower or reduced flow of content C exiting container 12 via aperture 24 verses open mouth 14 of container 12. Preferably tab 23 is sufficiently large or long enough so that it can be grasped by the fingers F of a user's hand H and will usually have sufficient strength so as to permit removal or partial removal of first seal 21 from rim 13 of mouth 14 and/or second seal 22 from first seal 21.

It is contemplated herein that tab 23 (second seal 22) may be perforated along hinged edge 29 to enable removal of tab 23 (second seal 22) from first seal 21.

It is further contemplated herein that aperture 24 may include two or more apertures 24.

The foregoing description and drawings comprise illustrative embodiments of the present disclosure. Having thus described exemplary embodiments, it should be noted by those ordinarily skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one ordinarily skilled in the art to which this invention pertains having the benefit of the teachings presented in the foregoing descriptions and the associated drawings. Although specific terms may be employed herein, they are used in a generic and descriptive sense only and not for purposes of limitation. Moreover, the present invention has been described in detail; it should be understood that various changes, substitutions and alterations can be made thereto without departing from the spirit and scope of the invention as defined by the appended claims. Accordingly, the present invention is not limited to the specific embodiments illustrated herein, but is limited only by the following claims.

What is claimed is:

1. An apparatus, to seal and unseal a rim of a mouth of a container, said apparatus comprising;

a first seal, said first seal having a perimeter, said perimeter of said first seal configured to removeable affix to the rim of the mouth of the container, and said first seal having an aperture formed therethrough said first seal, said aperture configured proximate said perimeter; a pull tab formed integral to said first seal-proximate said perimeter of said first seal, said pull tab configured to partially cover the mouth, said pull tab configured to remove said first seal from the rim of the mouth of the container, said pull tab further configured as a second seal hinged along said perimeter and adhered to said first seal to close off said aperture, and said pull tab hinged up along said periphery to remove said second seal from said first seal to open said aperture.

2. The apparatus of claim 1, wherein said first seal and said second seal are configured to hold a content therein said container.

3. The apparatus of claim 2, wherein said content is a fluid.

4. The apparatus of claim 2, wherein said content is a granular solid.

5. The apparatus of claim 2, wherein said content is a powder.

6. The apparatus of claim 1, wherein a first flow through said aperture is less than a second flow through said mouth.

7. The apparatus of claim 1, wherein said aperture is smaller in area than said mouth.

8. The apparatus of claim 1, wherein said aperture includes two or more apertures.

9. The apparatus of claim 1, wherein said aperture further comprises a removeable plug integral to said first seal.

10. A container seal system, the seal system comprising:

a container having an opening formed by a rim, said container filled with a content; and a first seal, said first seal with a periphery releasable affixed thereto the rim, said first seal having an aperture formed therethrough said first seal, said aperture configured proximate said periphery; and a pull tab formed integral to said first seal proximate said periphery of said first seal, said pull tab configured to partially cover the mouth, said pull tab configured to remove said first seal from the rim, said pull tab further configured as a second seal hinged along said perimeter and adhered to said first seal to close off said aperture, and said pull tab hinged up along said periphery to remove said second seal from said first seal to open said aperture.

11. The seal system of claim 10, wherein said first seal and said second seal close off said content therein said container.

12. The seal system of claim 11, wherein said content is a fluid.

13. The seal system of claim 11, wherein said content is a granular solid.

14. The seal system of claim 11, wherein said content is a powder.

15. The seal system of claim 10, wherein a first flow through said aperture is less than a second flow through said opening.

16. The seal system of claim 10, wherein said aperture is smaller in area than said opening.

17. The seal system of claim 10, wherein said aperture includes two or more apertures.

18. The seal system of claim 10, wherein said second seal is configured as a plug removeably integral to said first seal.

19. A method of reducing a flow of a content from a container, comprising steps of:

providing a container and a cap removeably affixed thereto, said container having an opening formed by a rim, said container filled with the content, a first seal, said first seal with a periphery releasably affixed thereto the rim, said first seal having an aperture formed therethrough said first seal, said aperture configured proximate said periphery, and a pull tab formed integral to said first seal proximate said periphery of said first seal, said pull configured to partially cover the mouth, said pull tab configured to remove said first seal from the rim, said pull tab further configured as a second seal hinged along said perimeter and adhered to said first seal to close off said aperture;

removing said cap therefrom said container;

unfolding said pull tab to remove said second seal from said first seal, exposing said aperture;

inverting said container to poor the content therethrough said aperture.

20. The method of claim 19, further comprises the step of folding said pull tab along said perimeter to adhere said pull tab to said first seal to close off said aperture.

* * * * *